US006621457B1

(12) United States Patent
Adams et al.

(10) Patent No.: US 6,621,457 B1
(45) Date of Patent: Sep. 16, 2003

(54) ULTRA BROADBAND ANTENNA HAVING ASYMMETRICAL SHORTING STRAPS

(75) Inventors: Richard C. Adams, San Diego, CA (US); Robert S. Abramo, San Diego, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 42 days.

(21) Appl. No.: 10/016,202

(22) Filed: Dec. 13, 2001

Related U.S. Application Data

(60) Provisional application No. 60/244,952, filed on Oct. 30, 2000.

(51) Int. Cl.[7] ..... H01Q 1/12
(52) U.S. Cl. ..... 343/718; 343/742
(58) Field of Search ..... 343/718, 741–743, 343/769; 455/575

(56) References Cited

U.S. PATENT DOCUMENTS

| | | | | |
|---|---|---|---|---|
| 3,266,042 A | * | 8/1966 | Mahoney et al. | 343/718 |
| 3,582,951 A | * | 6/1971 | Altmayer | 343/718 |
| 5,198,826 A | * | 3/1993 | Ito | 343/742 |
| 5,886,667 A | * | 3/1999 | Bondyopadhayay | 343/718 |

OTHER PUBLICATIONS

Lebaric, J. et al., "Ultra–Wideband Radio Frequency Hemmet Antenna", Provisional Patent Application, Oct. 15, 2001, 27 pages.

Gainor, T. et al., "Vest Antenna Assembly", Patent Application, Apr. 11, 2001, 26 pages.

Adams, R. et al., "COMWIN Antenna System Fiscal Year 2000 Report", Technical Report 1836, Sep. 2000, pp. 1–55.

* cited by examiner

*Primary Examiner*—Michael C. Wimer
(74) *Attorney, Agent, or Firm*—Michael A. Kagan; Peter A. Lipovsky; Allan Y. Lee

(57) ABSTRACT

An antenna includes a liner shaped to fit over a helmet; a first RF element attached to the liner; a second RF element attached to the liner so that the first and second RF elements are separated by a gap; an RF feed electrically connected to the first RF element for providing RF energy to the first RF element; a ground feed electrically connected to the second RF element; a first shorting strap that is electrically connected to the first and second elements opposite from the RF feed; and a second shorting strap electrically connected to the first and second RF elements between the first shorting strap and the RF feed. The shorting straps are used to generally match the impedance of the antenna to an electrical device such as a transmitter, receiver, or transceiver. A matching circuit may be connected in series between the first RF element and the RF feed to further refine matching the antenna impedance to the electrical device. In another embodiment of the invention, the RF elements may be mounted directly to the helmet, in applications where the helmet is made of a dielectric material.

13 Claims, 7 Drawing Sheets

ULTRA BROADBAND ANTENNA HAVING ASYMMETRICAL SHORTING STRAPS

This application claims the benefit of U.S. Provisional Application Serial No. 60/244,952, filed or, Oct. 30, 2000.

BACKGROUND OF THE INVENTION

The present invention generally relates to antennas, and more particularly, to an ultra-broadband antenna.

Most man-carried antennas have two disadvantages. First, they have a distinctive visual signature that uniquely identifies a radio operator and accompanying officer nearby, making them vulnerable to sniper fire. Because disruption of command, communications, and control is a paramount goal of snipers, reduction of the visual signature of the antenna is highly desirable. The second disadvantage is that man-carried antennas are generally specialized to one radio and often a very narrow band.

Therefore, a need exists for a broadband, man-carried antenna that does not have a readily identifiable visual signature.

SUMMARY OF THE INVENTION

The present invention provides an antenna that includes a liner shaped to fit over a helmet; a first RF element attached to the liner; a second RF element attached to the liner so that the first and second RF elements are separated by a gap; an RF feed electrically connected to the first RF element for providing RF energy to the first RF element; a ground feed electrically connected to the second RF element; a first shorting strap that is electrically connected to the first and second RF elements opposite from the RF feed; and a second shorting strap electrically connected to the first and second RF elements between the first shorting strap and the RF feed. The shorting straps are used to match the impedance of the antenna to an external load. A impedance matching circuit which may include elements such as capacitors, inductors, and resistors, may be connected in series between the RF feed and the first RF element to further reduce any impedance mismatch between the antenna and external load. In another embodiment of the invention, the RF elements may be mounted directly to the helmet, in applications where the helmet is made of a dielectric material.

An important advantage of the invention is that the open crown (i.e., no RF element is present in this area) at the top of the helmet allows the antenna to operate with a voltage standing wave ratio (VSWR) in the range of 3:1 over a bandwidth of 440–2310 MHz.

Another advantage of the invention is that it may be configured to fit over a soldier's helmet and exhibit practically no visual signature.

These and other advantages of the invention will become more apparent upon review of the accompanying drawings and specification, including the claims.

BRIEF DESCRIPTION OF THE DRAWINGS

Throughout the several view, like elements are referenced using like references.

DESCRIPTION OF THE PREFERRED EMBODIMENT

Figure 1:
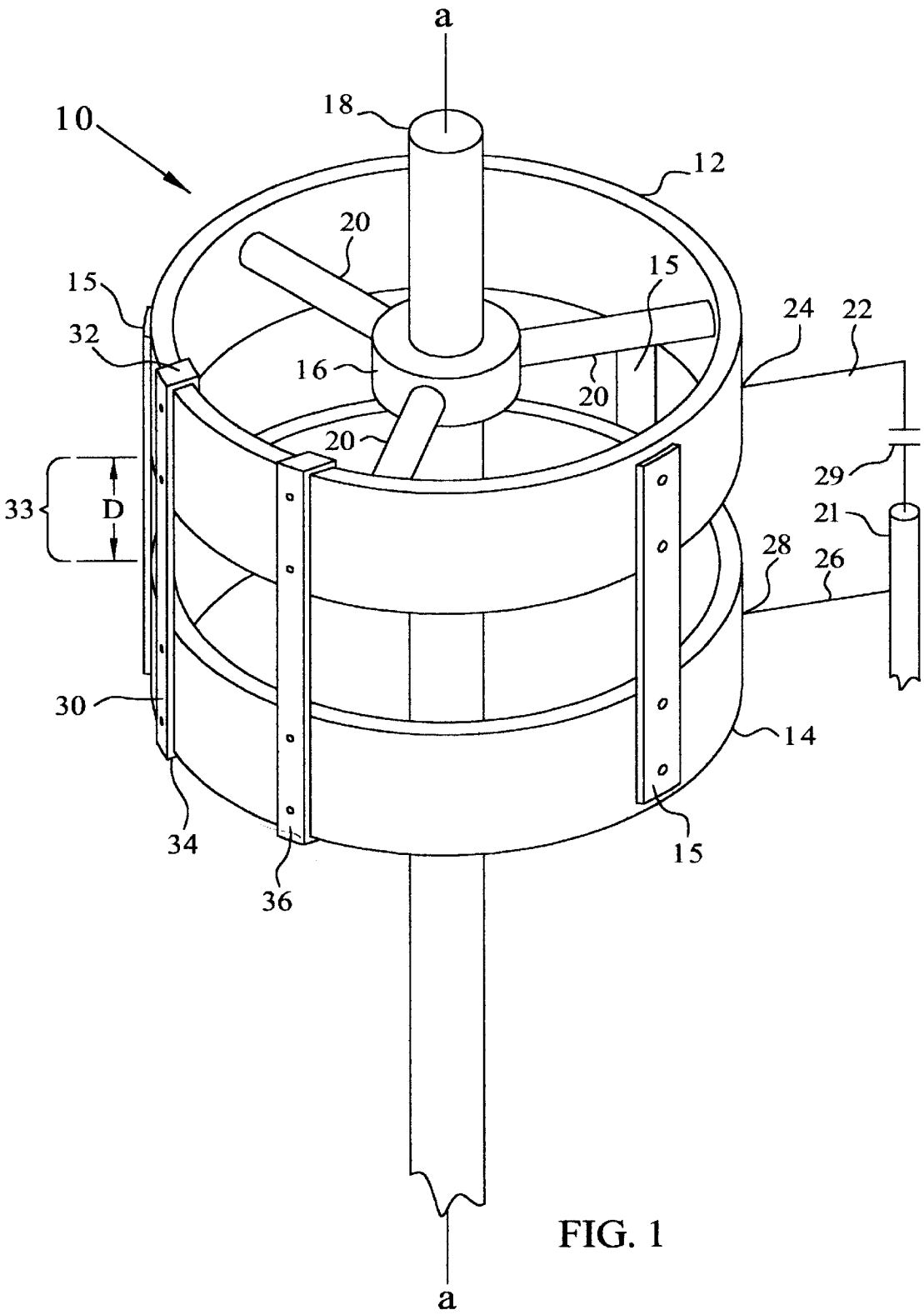
FIG. 1 illustrates an embodiment of a wide band antenna having asymmetrical shorting straps having various characteristics of the present invention.

The present invention is described with reference to FIG. 1 in which there is shown an antenna 10 having asymmetrical shorting straps for providing impedance matching with respect to an external load (not shown) whereby the antenna may be operated so as to have a voltage standing wave ratio within a relatively low range, as for example, 3:1. Antenna 10 includes first and second radio frequency (RF) elements 12 and 14 each having a ring-like or annulus shape. RF elements 12 and 14 each may be made of electrically conductive materials that include copper or aluminum that are separated from each other by a gap 33 having a distance D. Dielectric support structures 15 maintain the gap 33 between RF elements 12 and 14. Gap 33 creates a voltage difference between RF elements 12 and 14 when antenna 10 is excited with RF energy. Generally, $D \leqq 1.0$ cm, although the scope of the invention includes distances greater than that as may be required to suit the requirements of a particular application. A radio frequency element is a structure for propagating and/or directing radio frequency energy. Dielectric structures 15 provide mechanical support to maintain the gap between RF elements 12 and 14. By way of example, dielectric structures 15 may be separated from each other by approximately 120° about reference axis a—a. For purposes herein, a dielectric material is defined as an electrical insulating material having the real part of a dielectric constant $\epsilon$, where $\epsilon \geqq 1$. Examples of dielectric materials are Kevlar® and Teflon® which have dielectric constants of 2.5 and 4.2, respectively. A ring support 16 is mounted around an antenna mast 18 and has spokes 20 radially extending from reference axis a—a towards and attached to RF element 12. Antenna mast 18 has a longitudinal axis generally coincident with reference axis a—a to which support ring 16 is mounted. Spokes 20 are preferably made of a dielectric material such as carbon-fiber, fiberglass, plastic, and the like so that no direct electrical current may be conducted from RF elements 12 and 14 to antenna mast 18. Support ring 16 and antenna mast 18 may be made of any material, including dielectric or electrically conductive materials, that provides antenna 10 with suitable structural support.

Still referring to FIG. 1, a center feed 22, which extend from coaxial cable 21, is electrically connected to a first end 24 of RF element 12 for providing RF energy to antenna 10. A matching circuit which may, for example, include capacitor 29, is coupled between center feed 22 and end 24 of RF element 12 for finely matching the impedance of antenna 10 with an external load, not shown. However, it is to be understood that the matching circuit may include elements such as capacitors, inductors, and/or resistors. By way of example, capacitor 29 may have a fixed or variable capacitance within the range of about 4 to 11 pf. A ground lead 26, which may extend from coaxial cable 21, is electrically connected to second RF element 14 at end 28 of RF element 14 nearest end 24 of RF element 12.

Figure 2:
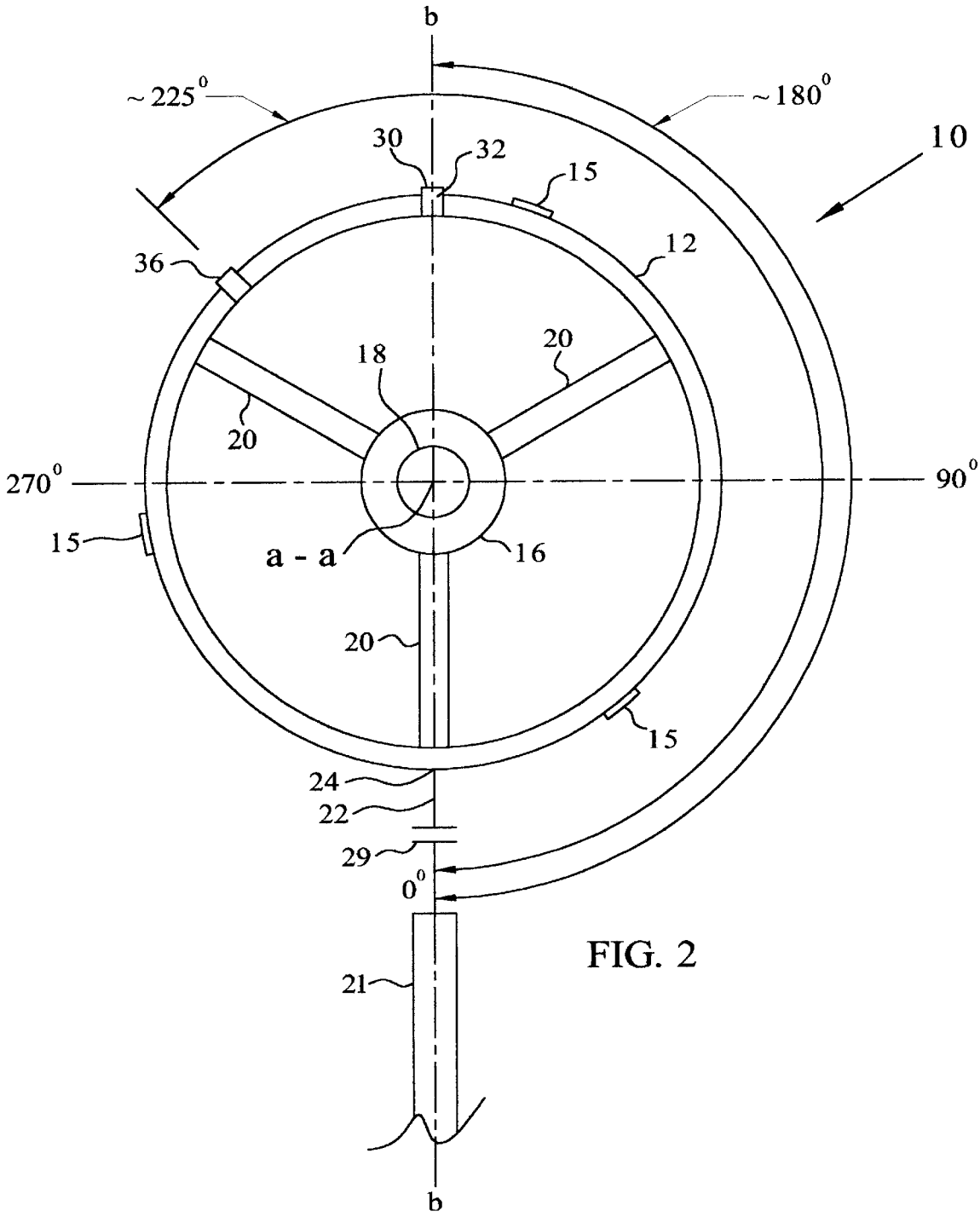
FIG. 2 shows a polar coordinate system superimposed over a plan view of the antenna of FIG. 1.

A first shorting strap 30 electrically connects first and second RF elements 12 and 14 at locations 32 and 34, which are generally diametrically opposite feed locations 24 and 28, respectively. A second shorting strap 36 is electrically connected to first and second RF elements 12 and 14 at a location between first shorting strap 30 and locations 24 and 28 where center feed 22 and ground feed 26 are attached to RF elements 12 and 24, respectively. As shown in FIG. 2, shorting straps 32 and 36 may be positioned at approximately 180° and 225° counter-clockwise (CCW), respectively, from the 0° reference position 24 along reference axis b—b that intersects and is orthogonal to reference axis a—a. However, it is to be understood that shorting strap 36 may be alternatively positioned in the range of about 120°–150° or 210°–240° CCW from the 0° reference position 24. Shorting straps 30 and 36 may be made of materials such as aluminum, copper, or other electrically conductive materials. Shorting straps 30 are used to generally match the impedance of antenna 10 with an electrical device (not shown) such as a transmitter and/or receiver that may be electrically coupled to coaxial cable 21. The exact position of shorting strap 36 with respect to shorting strap 30 is generally empirically determined to suit the requirements of a particular application, whereby changing the position of shorting strap 36 about reference axis a—a causes the impedance of antenna 10 to vary accordingly. Thus, it may be appreciated that as seen in FIG. 2, shorting straps 32 and 36 are asymmetrical with respect to reference axes a—a and b—b.

A second embodiment of the invention is described with reference to FIG. 3 where there is shown an antenna 50 having asymmetrical shorting straps for matching the antenna impedance with respect to an external signal source (not shown) or a receiver (not shown). Antenna 50 may be operated so as to exhibit a voltage standing wave ratio within a relatively low range, as for example, 3:1 over a frequency range of 440 to 2310 MHz, and may be fitted over a helmet 51. Antenna 50 includes first and second radio frequency (RF) elements 52 and 54, respectively, each preferably made of electrically conductive and flexible material. When antenna 50 is fitted around helmet 51, RF elements 52 and 54 each are shaped as a tapered band or annulus. The annulus shaped RF elements 52 and 52 are open on two sides which provides antenna 50 with ultra-wide band performance, as described further herein. RF elements 52 and 54 may be made of electrically conductive material such as copper or aluminum, and may be configured as a suitably shaped net that includes copper or aluminum wire. RF elements 52 and 54 may also be made of an electrically conductive and very flexible mesh structure that includes woven copper, or copper coated fabric. If formed as a net or mesh, the mesh spacing should be less than about 0.1λ, where λ represents the shortest wavelength of the radio frequency signal that is to be detected or transmitted by antenna 50. An example of a suitable electrically conductive mesh structure from which RF elements 52 and 54 may be made is Flectron®, which is available from Applied Performance Materials, Inc. of St. Louis. A further characteristic of Flectron® is that it is breathable.

RF elements 52 and 54 are separated by a gap 55 having a distance S when antenna 50 is fitted over helmet 51. Gap 55 provides a voltage difference between RF elements 52 and 54 when antenna 50 is excited by RF energy. In typical applications, S<1.0 cm, although the scope of the invention includes gap 55 having a distance greater than 1.0 cm as may be required to suit the requirements of a particular application. Desirable characteristics of a material suitable for use as RF elements 52 and 54 are that the material be highly electrically conductive and flexible. The widths W of RF elements 52 and 54 may be in the range of about 1 to 8 cm, depending on the desired frequency range of the antenna. In one particular implementation of antenna 50, W was 6 cm, and generally depends on the desired frequency range of antennas 50. In one variation of antenna 50, RF elements 52 and 54 are mounted to an electrically insulating liner 56 which serves as a supporting substrate for RF elements 52 and 54. Liner 56 may, for example, be made of cotton, polyester, or other dielectric material that may be woven or non-woven and shaped to fit over helmet 51. RF elements may be attached to liner 56, as for example, by being sewed or glued.

Figure 3:
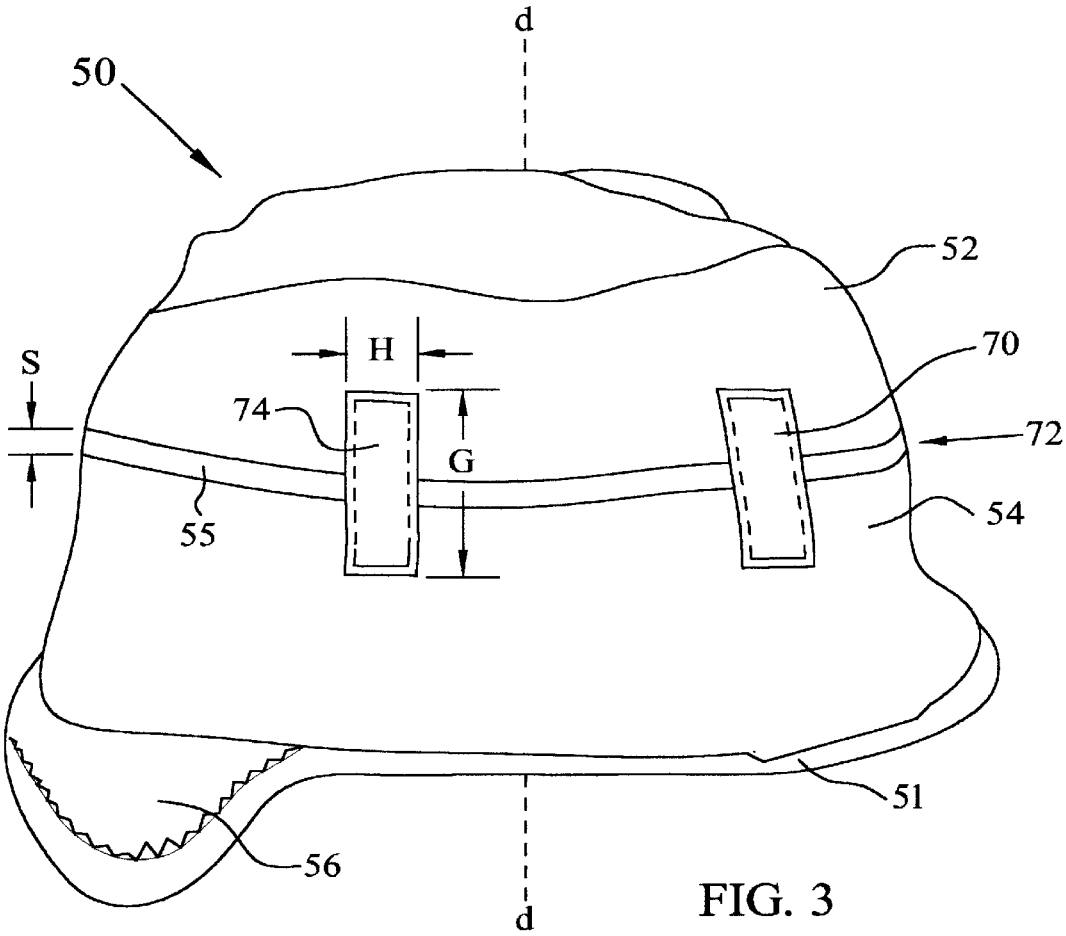
FIG. 3 shows a perspective view of a second embodiment of a wide band antenna having asymmetrical shorting straps that fits over a helmet.
Figure 4:
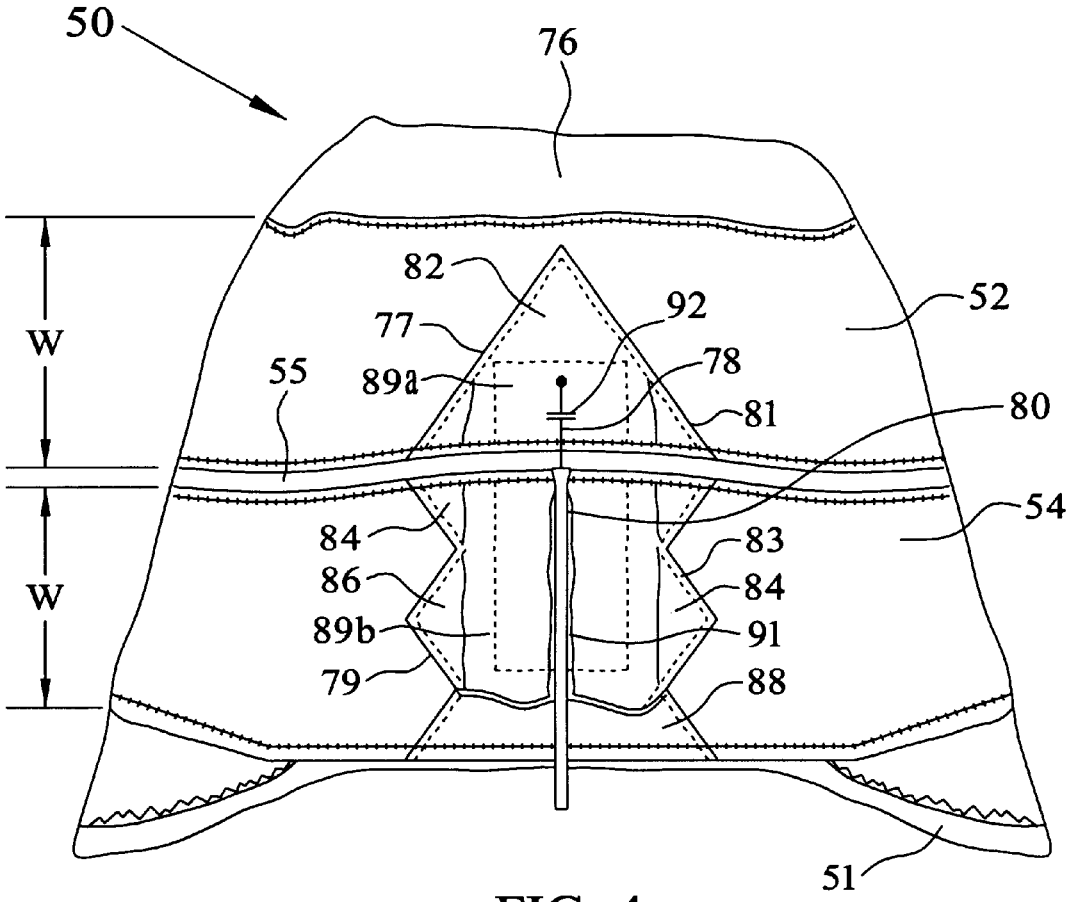
FIG. 4 shows RF energy input and ground connections in another view of the antenna of FIG. 3.

Referring to FIG. 3, antenna 50 includes a first shorting strap 70 that electrically connects first and second RF elements 52 and 54 towards the front end 72 of antenna 50. A second shorting strap 74 is electrically connected to first and second RF elements 52 and 54 at a location between first shorting strap 70 and end 76 of antenna 50 shown in FIG. 4 where center feed 78 and ground feed 80 are electrically connected through electrically conductive fabric patches 82 and 84 to RF elements 52 and 54, respectively, as for example, by soldering. Exemplary dimensions of shorting straps 72 and 74 are such that they may have a width H of about 2.5 cm and a length G of about 5 cm. However, the shorting straps may be configured to have geometric shapes other than rectangles. Shorting straps 70 and 74 tend to lower the overall voltage standing wave ratio (VSWR) of antenna 50 over its entire frequency range. Lowering the VSWR helps to match generally the impedance of antenna 50 with an external electrical device (not shown) that may be connected to center feed 78 and ground 80. Examples of such an electrical device include a transmitter, receiver, and transceiver. Shorting straps 70 and 74 may be made of the same material as that used for RF elements 52 and 54, such as Flectron®, but may also be made of other electrically conductive material. Shorting straps 70 and 74 may be attached to RF elements 52 and 54 by methods that include bonding, soldering, riveting, sewing. It is to be understood that the scope of the invention further includes methods for attaching the shorting straps to the RF elements other than those specifically exemplified above.

Figure 5:
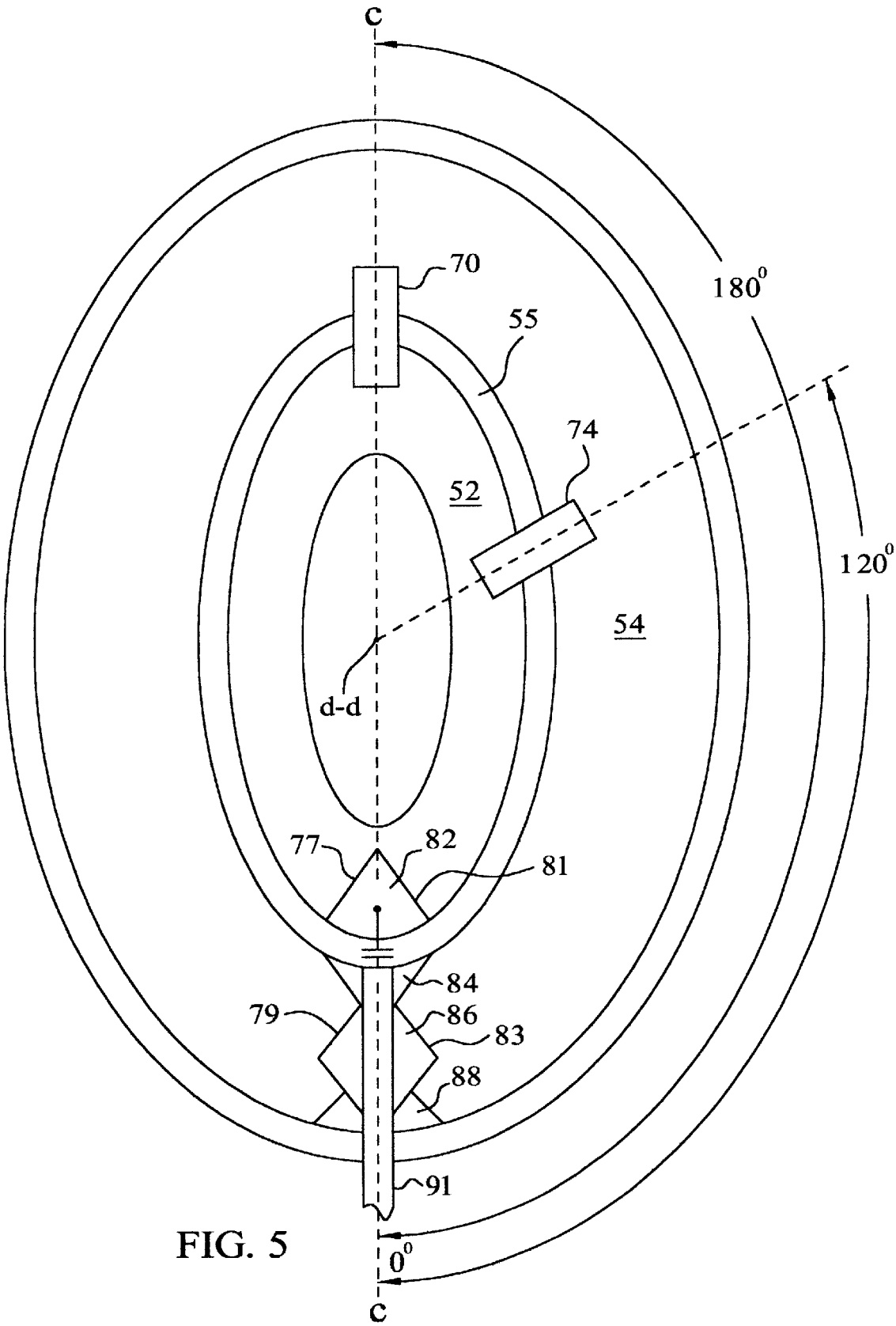
FIG. 5 shows a top view of the antenna fitted over a helmet.

Electrically conductive patches 82, 84, 86, and 88 are attached to the corresponding RF elements 52 and 54 at end 76 of antenna 50 to form zig-zag patterns 77, 79, 81, and 83 in order to provide good RF coupling between patches 82, 84, 86, and 88, and corresponding RF elements 52 and 54. Electrically conductive patches 82, 84, 86, and 88 may be shaped as sections of overlapping rectangles that are sewn or bonded to the RF elements to provide excellent electrical continuity therebetween. A section of a rectangular shaped patch 89*a* is sewn to patch 82, and a section of a rectangular shaped patch 89*b* is sewn to patches 84, 86, and 88. Referring also to FIG. 5, the patches 82, 84, 86, 88, and 89*a*, and 89*b* collectively facilitate soldering RF feed 78 to patch 89*a* and ground feed 91 to patch 89*b* without damaging the RF elements 52 and 54 when the latter are made of Flectron®. It is to be understood that RF feed 78 and ground feed 91 are RF isolated from each other.

Figure 6:
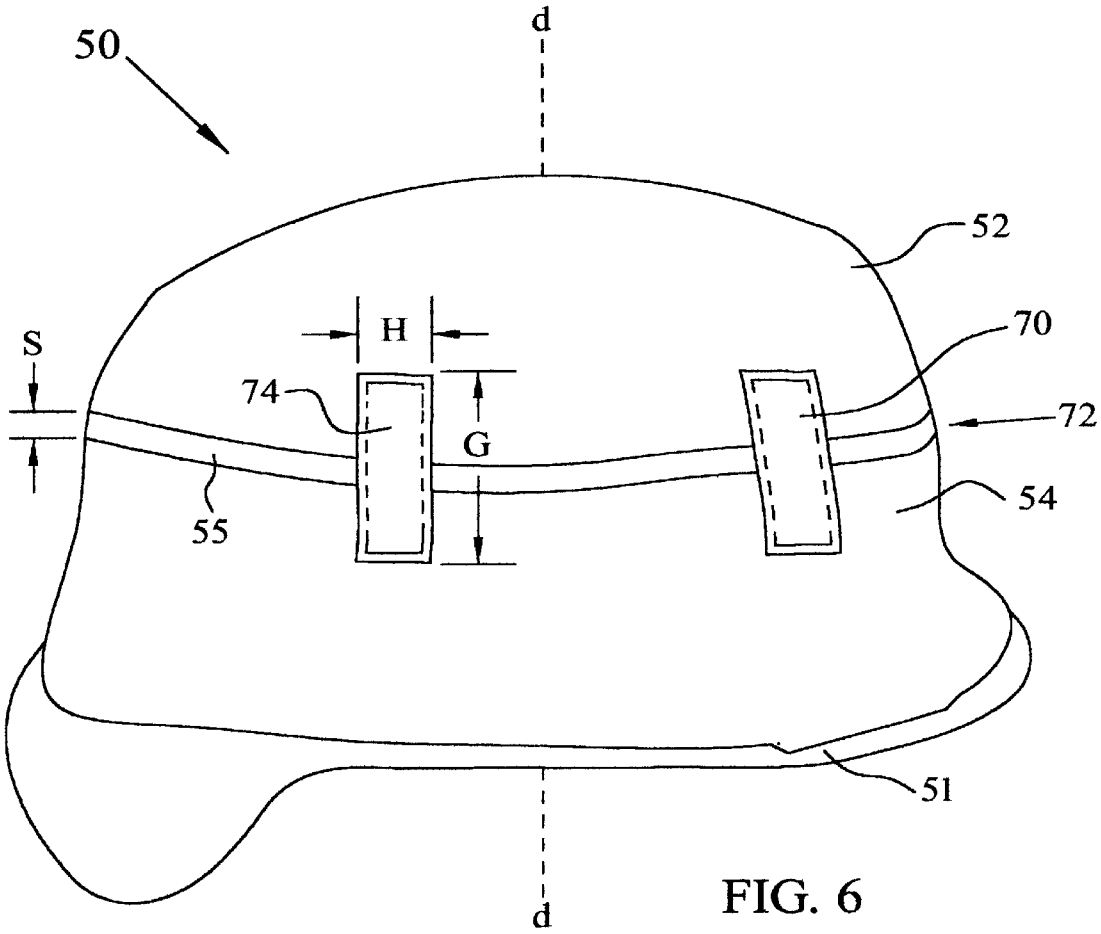
FIG. 6 shows the RF elements of a wide band antenna having asymmetrical shorting straps attached directly to a helmet without the need for an interposing liner.
Figure 7:
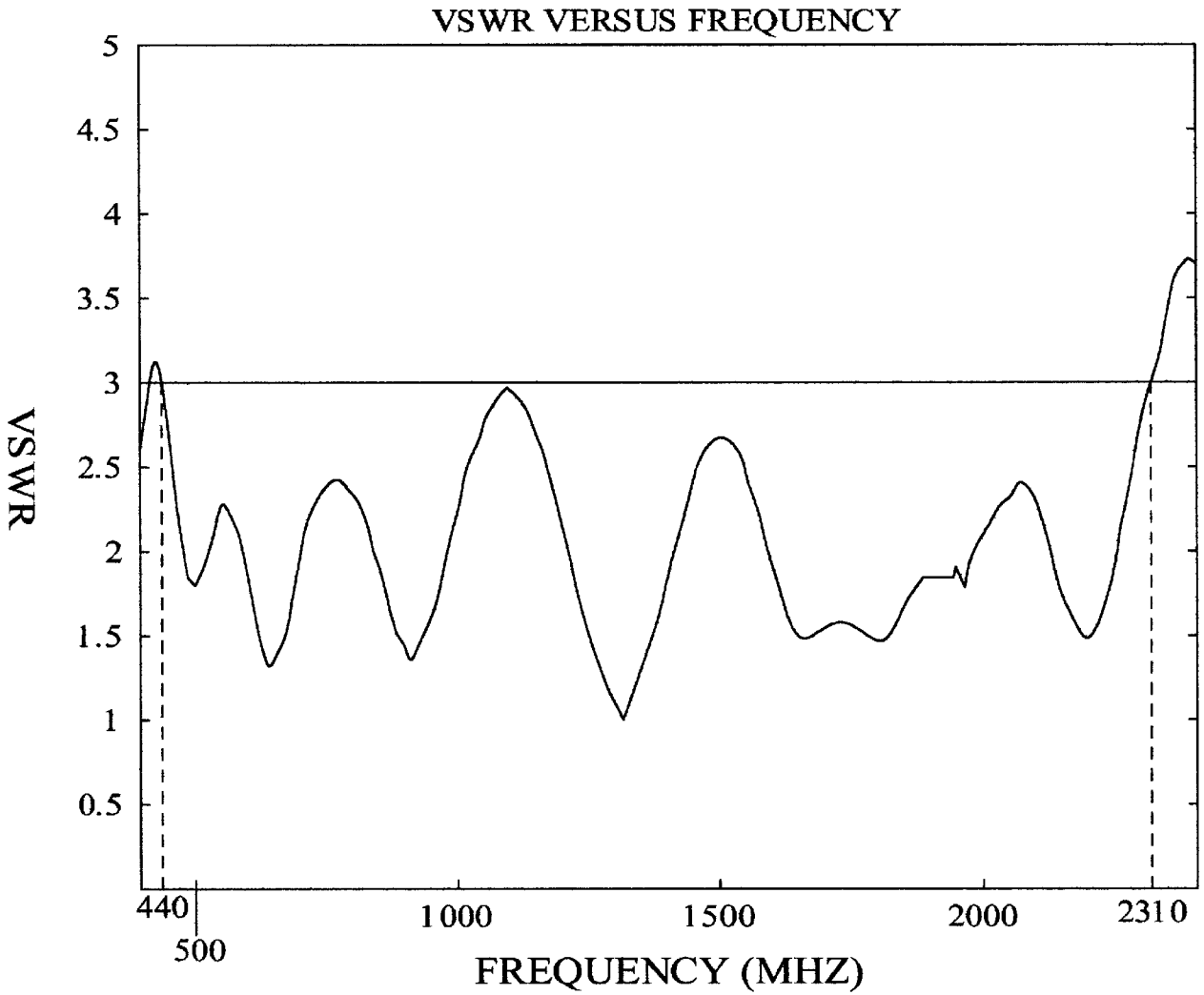
FIG. 7 shows the VSWR performance of the antenna of FIG. 3.

Shorting straps 70 and 74 are used to match the impedance of antenna 50 with a device (not shown), such as a transmitter, transceiver, or receiver, that may be electrically coupled to RF feed 78 and ground feed 91. The exact position of shorting strap 70 with respect to shorting strap 74 is generally empirically determined to suit the requirements of a particular application, whereby changing the position of the shorting straps causes the impedance of antenna 50 to vary accordingly. For example, as shown in FIG. 5, shorting strap 74 may be located approximately 120° CCW from the 0° reference position on reference axis c—c about reference axis d—d, where reference axis c—c intersects and is orthogonal to reference axis d—d. Shorting strap 70 may be located approximately 180° CCW from the 0° reference position on reference axis c—c about reference axis d—d. Thus, it may be appreciated that shorting straps 70 and 74 are asymmetrical about reference axis d—d. In general, typical modem helmets such as helmet 51 are made of Kevlar® or some other dielectric material. RF elements 52 and 54 may be attached directly to helmets made of dielectric material without any intervening liner as shown in FIG. 6. Helmet 51 may be implemented as any type of helmet, including combat and construction helmets.

The impedance of the head of the person (not shown) wearing helmet 51 affects the impedance of antenna 50. Therefore, in order to facilitate finely matching the impedance of antenna 50 with some external electronic device, then as shown in FIG. 5, an impedance matching circuit, which may be implemented as capacitor 92, may be connected between center feed 78 and patch 82 which is electrically connected to RF element 52. The matching circuit may include elements such as capacitors, inductors, and/or resistors. Capacitor 92 may be a fixed or variable capacitor having a capacitance in the range of 4–11 pf for fine tuning the reactive capacitance of the combination of antenna 50 and the head of the person wearing helmet 51.

The fact that each RF element is shaped as a band or annulus, rather than crown, i.e., bowl-shaped, provides antenna 50 with significant performance benefits because the open loop shape allows the antenna to operate at a relatively low VSWR of 3:1 over a frequency range of about 440 to 2310 MHz.

Obviously, many modifications and variations of the present invention are possible in light of the above teachings. It is therefore to be understood that within the scope of the appended claims, the invention may be practiced otherwise than as specifically described.

We claim:

1. An antenna, comprising:

a liner shaped to fit over a helmet;

a first RF element attached to said liner;

a second RF element attached to said liner so that said first and second RF elements are separated by a gap;

an RF feed electrically connected to said first RF element for providing RF energy to said first RF element;

a ground feed electrically connected to said second RF element;

a first shorting strap that is electrically connected to said first and second RF elements opposite from said RF feed; and a second shorting strap electrically connected to said first and second RF elements between said first shorting strap and said RF feed.

2. The antenna of claim 1 wherein said first and second RF elements are made of a flexible electrically conductive material.

3. The antenna of claim 2 wherein said flexible electrically conductive material is woven into a mesh structure.

4. The antenna of claim 3 further including a helmet made of a dielectric material for supporting said liner.

5. The antenna of claim 4 wherein said first and second RF elements each have an annulus shape when said liner is fitted over said helmet.

6. The antenna of claim 5 wherein said antenna operates with a voltage standing wave ratio of 3:1 over a frequency range of 440 through 2310 MHz.

7. The antenna of claim 1 further including a matching circuit connected in series between said first RF element and said RF feed.

8. An antenna, comprising:

a helmet made of a dielectric material;

a first RF element attached to said dielectric material;

a second RF element attached to said dielectric material so that said first and second RF elements are separated by a gap;

an RF feed electrically connected to said first RF element for providing RF energy to said first RF element;

a ground feed electrically connected to said second RF element;

a first shorting strap that is electrically connected to said first and second RF elements opposite from said RF feed; and a second shorting strap electrically connected to said first and second RF elements between said first shorting strap and said RF feed.

9. The antenna of claim 8 wherein said first and second RF elements are made of a flexible electrically conductive material.

10. The antenna of claim 9 wherein said flexible conductive material is woven into a mesh structure.

11. The antenna of claim 10 wherein said antenna operates with a voltage standing wave ratio of 3:1 over a frequency range of 440 through 2310 MHz.

12. The antenna of claim 8 further including a matching circuit connected in series between said first RF element and said RF feed.

13. The antenna of claim 8 wherein said first and second RF elements each have an annulus shape.

* * * * *